US008308272B2

(12) United States Patent
Naruse et al.

(10) Patent No.: US 8,308,272 B2
(45) Date of Patent: Nov. 13, 2012

(54) IMAGE FORMING APPARATUS AND CARRIAGE DOCKING MECHANISM

(75) Inventors: Shinichiro Naruse, Kanagawa (JP); Ichiro Komuro, Kanagawa (JP); Mamoru Yorimoto, Tokyo (JP); Soichi Saiga, Tokyo (JP); Ryusuke Mase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 87 days.

(21) Appl. No.: 13/028,599

(22) Filed: Feb. 16, 2011

(65) Prior Publication Data

US 2011/0205299 A1 Aug. 25, 2011

(30) Foreign Application Priority Data

Feb. 19, 2010 (JP) ..... 2010-035001

(51) Int. Cl.
*B41J 23/00* (2006.01)

(52) U.S. Cl. ..... 347/37; 347/20; 347/40

(58) Field of Classification Search ..... 347/20, 347/37, 38, 40, 42, 49, 85, 86
See application file for complete search history.

(56) References Cited

U.S. PATENT DOCUMENTS

| | | | | |
|---|---|---|---|---|
| 5,949,443 | A * | 9/1999 | Yamamoto et al. | 347/3 |
| 7,789,484 | B2 * | 9/2010 | Takada et al. | 347/37 |
| 2010/0295897 | A1 | 11/2010 | Naruse et al. | |

FOREIGN PATENT DOCUMENTS

| | | |
|---|---|---|
| JP | 60-49973 | 3/1985 |
| JP | 7-156507 | 6/1995 |
| JP | 9-109423 | 4/1997 |
| JP | 9-240097 | 9/1997 |

* cited by examiner

*Primary Examiner* — Thinh Nguyen
(74) *Attorney, Agent, or Firm* — Cooper & Dunham LLP

(57) ABSTRACT

An image forming apparatus including a first carriage movable in a main scanning direction, a second carriage separatably dockable with the first carriage, a first positioning unit to position the second carriage relative to the first carriage in a sub-scanning direction, a second positioning unit to position the second carriage relative to the first carriage in a rotary direction, and a third positioning unit to position the second carriage relative to the first carriage in the main scanning direction. The first positioning unit includes a reference shaft and notched positioning members to engage the reference shaft. The second positioning unit contacts one of the first and second carriages in the rotary direction upon docking of the first and second carriages. The third positioning unit includes a positioning member, parallel grooved members in the sub-scanning direction, and parallel shafts extending in the sub-scanning direction to engage the grooved members.

10 Claims, 7 Drawing Sheets

IMAGE FORMING APPARATUS AND CARRIAGE DOCKING MECHANISM

BACKGROUND

1. Technical Field

This disclosure relates generally to an image forming apparatus, and more particularly, to an image forming apparatus using a recording head including a liquid ejection head that ejects liquid droplets.

2. Description of the Background

One example of related-art image forming apparatuses such as printers, copiers, plotters, facsimile machines, and multifunction devices having two or more of printing, copying, plotting, and facsimile functions is an inkjet recording device employing a liquid ejection recording method. The inkjet recording device includes a recording head that ejects droplets of a recording liquid such as ink onto a sheet of a recording medium while the sheet is conveyed to form an image on the sheet.

Examples of the inkjet recording device include a serial-type image forming apparatus, in which the recording head ejects liquid droplets while moving in a main scanning direction to form an image on the sheet as the sheet is moved in a sub-scanning direction perpendicular to the main scanning direction, and a line-type image forming apparatus equipped with a line-type recording head that ejects liquid droplets and does so without moving to form an image on the sheet as the sheet is moved in the sub-scanning direction.

A maintenance mechanism that maintains performance of the recording head is essential for the image forming apparatus employing the liquid ejection recording method. One of the functions of the maintenance mechanism is to discharge bubbles, foreign substances, coagulated ink, and so forth present in the recording head through nozzles in the recording head in order to prevent irregular ejection of the ink from the nozzles in the recording head.

In addition, a full-color image forming apparatus that forms full-color images using the liquid ejection recording method generally includes two separate recording heads, that is, a recording head that ejects black ink droplets (hereinafter referred to as the first recording head) and a recording head that ejects color ink droplets (hereinafter referred to as the second recording head). In such a full-color image forming apparatus, not only black ink but also color ink is ejected for maintenance of the recording heads even when monochrome printing is performed using only the first recording head, causing a waste of color ink and a concomitant cost increase.

In order to solve this problem, some image forming apparatuses deploy separate carriages for the black and color inks. That is, they include a first carriage mounting a first recording head that ejects black ink droplets and a second carriage mounting a second recording head that ejects color ink droplets. The first and second carriages are separatably dockable with each other to form full-color images.

For example, the first and second carriages may be selectively dockable with each other via a scanner (or a carrier) using a gripper. In order to prevent looseness between the first and second carriages docked with each other via the scanner, a home position sensor provided at a certain position in the image forming apparatus is used in conjunction with blocking plates respectively provided to the first and second carriages and the scanner. Accordingly, a correction amount for controlling relative positions of the first and second carriages is obtained based on the timing with which each of the blocking plates block light emitted from the home position sensor.

In another approach, a lock is further provided to the scanner to engage a gripped portion provided to each of the first and second carriages to lock the scanner and the first and second carriages together.

In yet another approach, multiple carriages each mounting different print mechanisms such as a letter print mechanism, a dot print mechanism, and a thermal print mechanism are supported by a support shaft and are carried by a carrier. The carriages and the carrier are separatably coupled by a coupling member provided therebetween.

There is also known a technique for accurately positioning a head cartridge on a carriage upon replacement of the head cartridge with a new head cartridge. In such a technique, the head cartridge includes an operation member that positions the head cartridge in the carriage on a guide rod that guides the carriage, and a protrusion having a reference surface that contacts the carriage upon mounting of the head cartridge on the carriage.

However, in the configuration in which the first and second carriages are docked with and separated from each other through an intermediate member such as the scanner and the gripper, the accuracy with which the relative positions of the first and second carriages are secured is decreased due to the use of the intermediate member, thus degrading image quality of full-color images.

Further, repeated docking and separation of the first and second carriages change the relative positions of the first and second carriages over time, thus also degrading image quality of full-color images.

SUMMARY

In this disclosure, a novel image forming apparatus including first and second carriages separatably dockable with each other is provided to accurately dock the first and second carriages, thereby providing higher-quality full-color images.

In one illustrative embodiment, an image forming apparatus includes a first carriage having a first recording head to eject black liquid droplets and movable in a main scanning direction, a second carriage having a second recording head to eject color liquid droplets and separatably dockable with the first carriage within a main scanning range of the first carriage, a first positioning unit to position the second carriage relative to the first carriage in a sub-scanning direction perpendicular to the main scanning direction, a second positioning unit provided to at least one of the first and second carriages to position the second carriage relative to the first carriage in a rotary direction rotating around the reference shaft, and a third positioning unit to position the second carriage relative to the first carriage in the main scanning direction. The first positioning unit includes a reference shaft provided to one of the first and second carriages and extending in the main scanning direction, and notched positioning members provided to the other one of the first and second carriages to engage the reference shaft. The second positioning unit contacts the other one of the first and second carriages in the rotary direction upon docking of the first and second carriages. The third positioning unit includes a positioning member, grooved members provided parallel to each other in the sub-scanning direction, and shafts provided parallel to each other in the sub-scanning direction to engage the grooved member. The grooved members are provided to one of the carriages and the positioning member, and the shafts are provided to the other of the carriages and the positioning member.

In another illustrative embodiment, a carriage docking mechanism for an image forming apparatus includes a first positioning unit to position a second carriage relative to a first carriage in a second direction orthogonal to a first direction, a second positioning unit provided to at least one of the first and second carriages to position the second carriage relative to the first carriage in a third direction orthogonal to both the first direction and the second direction, and a third positioning unit to position the second carriage relative to the first carriage in the first direction. The first positioning unit includes a reference shaft provided to one of the first and second carriages and extending in the first direction, and notched positioning members provided to the other one of the first and second carriages to engage the reference shaft. The second positioning unit contacts the other one of the first and second carriages from the third direction upon docking of the first and second carriages. The third positioning member includes a positioning member, parallel grooved members in the second direction provided to one of the carriages and the positioning member, and parallel shafts extending in the second direction and provided to the other of the carriages and the positioning member to engage the grooved members.

In yet another illustrative embodiment, an image forming apparatus includes the carriage docking mechanism described above.

Additional aspects, features, and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF ILLUSTRATIVE EMBODIMENTS

Figure 1:
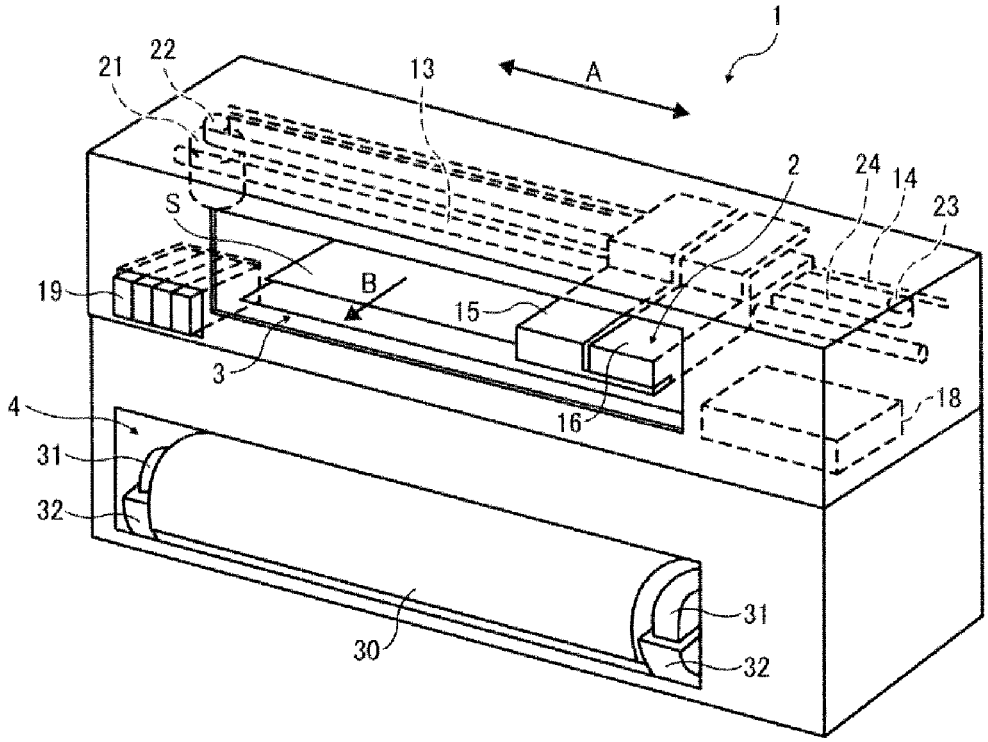
FIG. 1 is a perspective view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Image forming apparatuses hereinafter described form an image on a recording medium, such as paper, string, fiber, cloth, lather, metal, plastics, glass, wood, and ceramics by ejecting liquid droplets onto the recording medium. In this specification, an image refers to both signifying images such as characters and figures, as well as a non-signifying image such as patterns. In addition, ink includes any material which is a liquid when ejected from a recording head, such as a DNA sample, a resist material, and a pattern material. Further, an image formed on the recording medium is not limited to a flat image, but also includes an image formed on a three-dimensional object, a three-dimensional image, and so forth.

Figure 2:
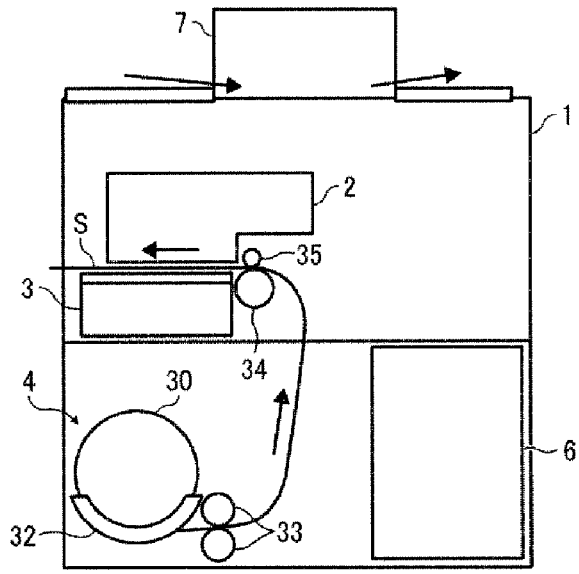
FIG. 2 is a vertical cross-sectional view illustrating the configuration of the image forming apparatus illustrated in FIG. 1.
Figure 3:
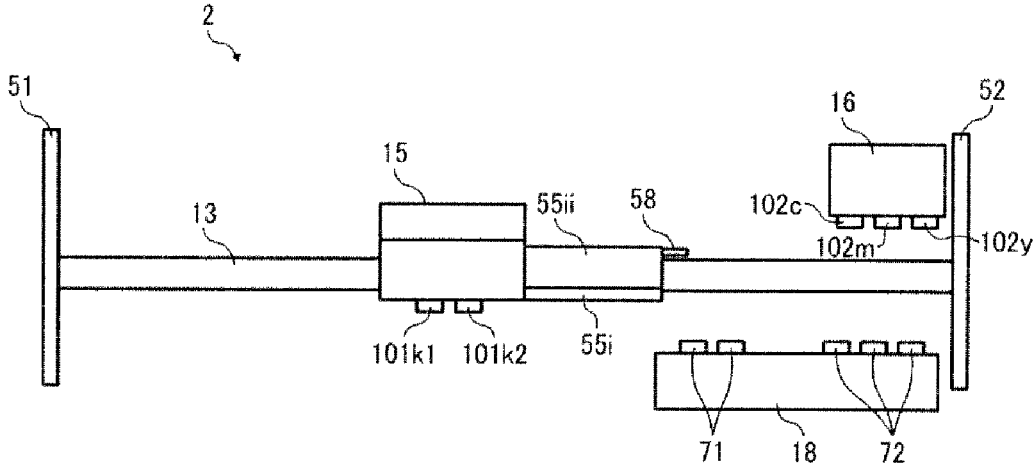
FIG. 3 is a front view illustrating an example of a configuration of an image forming unit of the image forming apparatus illustrated in FIG. 1.

A description is now given of a configuration and operation of an inkjet recording device serving as an image forming apparatus 1 according to illustrative embodiments with reference to FIGS. 1 to 3. FIG. 1 is a perspective view illustrating an example of a configuration of the image forming apparatus 1. FIG. 2 is a vertical cross-sectional view illustrating the configuration of the image forming apparatus 1. FIG. 3 is a front view illustrating an example of a configuration of an image forming unit 2 of the image forming apparatus 1.

The image forming apparatus 1 is a serial-type inkjet recording device, and includes the image forming unit 2, a sheet conveyance unit 3, a sheet roll storage 4, an electrical substrate storage 6, an image reading unit 7 provided at the top thereof, and so forth. It is to be noted that the image reading unit 7 is omitted in FIG. 1 for ease of illustration.

In the image forming unit 2, a guide rod 13 and a guide rail 14 are extended between lateral plates 51 and 52, and a first carriage 15 that ejects black ink droplets is slidably held by the guide rod 13 and the guide rail 14 in a direction indicated by a double-headed arrow A in FIG. 1 (hereinafter referred to as the main scanning direction). A second carriage 16 that ejects color ink droplets can be docked with and separated from the first carriage 15. It is to be noted that FIG. 1 illustrates a state in which the first and second carriages 15 and 16 are docked together, and FIG. 3 illustrates a state in which the first and second carriages 15 and 16 are separated from each other.

A main scanning mechanism that moves the first carriage 15 reciprocally back and forth in the main scanning direction includes a drive motor 21 positioned at one end of the image forming apparatus 1 in the main scanning direction, a drive pulley 22 rotatively driven by the drive motor 21, a driven pulley 23 provided at the other end of the image forming apparatus 1 in the main scanning direction, and a belt member 24 wound around the drive pulley 22 and the driven pulley 23. A tension spring, not shown, applies tension to the driven pulley 23 to separate the driven pulley 23 from the drive pulley 22. A part of the belt member 24 is fixed to a mount provided to a back surface of the first carriage 15 to guide the first carriage 15 in the main scanning direction.

An encoder sheet, not shown, is provided along the main scanning direction in order to detect a main scanning position of the first carriage 15. The encoder sheet is read by an encoder sensor, not shown, provided to the first carriage 15.

The first carriage 15 has a main scanning range through which it scans, and within this range is a recording range. A sheet S fed from a sheet roll 30 is intermittently conveyed to the recording range by the sheet conveyance unit 3 in a direction perpendicular to the main scanning direction indicated by an arrow B in FIG. 1 (hereinafter referred to as the sub-scanning direction).

An ink cartridge 19 that stores ink of a specific color, that is, yellow (Y), cyan (C), magenta (M), or black (K), to be supplied to sub-tanks included in recording heads provided to the first and second carriages 15 and 16, is detachably attached to the image forming apparatus 1 at the one end of the image forming apparatus 1 in the main scanning direction, that is, a portion outside the main scanning range of the first carriage 15. A maintenance mechanism 18 that performs maintenance and recovery of the recording heads is provided at the other end of the image forming apparatus 1 in the main scanning direction within the main scanning range of the first carriage 15. The maintenance mechanism 18 includes caps 71 that cap the recording heads of the first carriage 15, caps 72 that cap the recording heads of the second carriage 16, a wiper member, not shown, and so forth.

The sheet roll 30 is set in the sheet roll storage 4 serving as a sheet feed unit. The sheet roll 30 having different widths can be set in the sheet roll storage 4. Flanges 31 are attached to both ends of a paper core of the sheet roll 30 and are placed on flange bearings 32, respectively. Support rollers, not shown, are provided to the flange bearings 32 to contact outer circumferential surfaces of the flanges 31, respectively, thereby rotating the flanges 31 to feed the sheet S from the sheet roll 30.

The sheet S fed from the sheet roll 30 set in the sheet roll storage 4 is conveyed by conveyance members such as a pair of rollers 33, a drive roller 34, and a driven roller 35 from the back to the front of the image forming apparatus 1 to reach the recording range. In monochrome printing, the first carriage 15 is moved reciprocally in the main scanning direction, and the recording heads of the first carriage 15 are driven to eject black ink droplets onto the sheet S based on image data while the sheet S is intermittently conveyed in the sub-scanning direction. By contrast, in full-color printing, the first and second carriages 15 and 16 are docked together, and the recording heads of the first and second carriages 15 and 16 are together driven to eject ink droplets of the specified color onto the sheet S based on image data. Accordingly, a desired image is formed on the sheet S. The sheet S having the image thereon is then cut to a predetermined length and is discharged to a discharge tray, not shown, provided to the front of the image forming apparatus 1.

Figure 4:
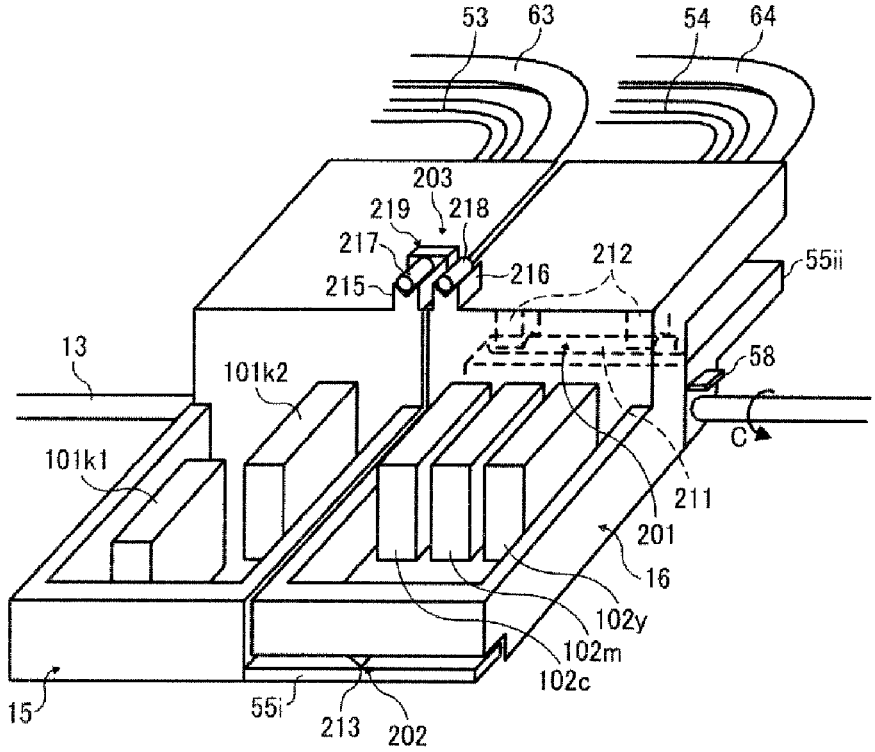
FIG. 4 is a perspective view illustrating an example of a configuration of first and second carriages docked with each other according to illustrative embodiments.
Figure 5:
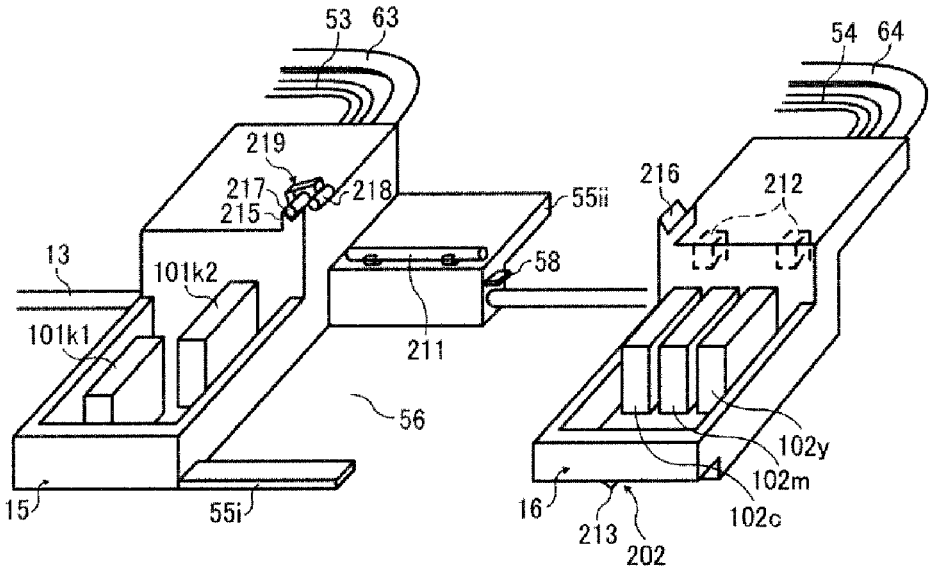
FIG. 5 is a perspective view illustrating an example of a configuration of the first and second carriages separated from each other according to illustrative embodiments.

A description is now given of a configuration of each of the first and second carriages 15 and 16 according to illustrative embodiments with reference to FIGS. 4 and 5. FIG. 4 is a perspective view illustrating an example of a configuration of the first and second carriages 15 and 16 docked with each other. FIG. 5 is a perspective view illustrating an example of a configuration of the first and second carriages 15 and 16 separated from each other.

The first carriage 15 includes first recording heads 101*k*1 and 101*k*2 (hereinafter collectively referred to as first recording heads 101) each including a liquid ejection head that ejects black ink droplets. The first recording heads 101 are offset from each other in the main scanning direction on the first carriage 15, and the first carriage 15 is moved reciprocally in the main scanning direction along the guide rod 13 by the main scanning mechanism. Black ink is supplied from the ink cartridge 19 provided to the image forming apparatus 1 to the sub-tanks integrally formed with the first recording heads 101 through a tube 53. Alternatively, replaceable ink cartridges may be attached to the first recording heads 101. A harness 63 serving as a signal transmission member that transmits a drive signal to the first recording heads 101 is connected to the first carriage 15.

The second carriage 16 includes second recording heads 102*c*, 102*m*, and 102*y* (hereinafter collectively referred to as second recording heads 102), each including a liquid ejection head that ejects ink droplets of a specific color, that is, cyan (C), magenta (M), or yellow (Y). The second recording heads 102 are disposed on the second carriage 16 at the same position as the first recording head 101*k*2 in the main scanning direction. The second carriage 16 is docked with the first carriage 15 to be moved reciprocally in the main scanning direction together with the first carriage 15 by reciprocating movement of the first carriage 15. Ink of the specified color is supplied from the ink cartridge 19 provided to the image forming apparatus 1 to the sub-tanks integrally formed with the second recording heads 102 through a tube 54. Alternatively, replaceable ink cartridges may be attached to the second recording heads 102. A harness 64 serving as a signal transmission member that transmits a drive signal to the second recording heads 102 is connected to the second carriage 16.

The first carriage 15 has mounts 55*i* and 55*ii* (hereinafter collectively referred to as mounts 55) to place the second carriage 16 thereon, and a cutout 56 is formed between the mounts 55. When the second carriage 16 is placed on the mounts 55 to be docked with the first carriage 15, the color ink droplets are ejected from the second recording heads 102 of the second carriage 16 onto the sheet S through the cutout 56, and the caps 72 of the maintenance mechanism 18 are moved up and down within the cutout 56.

The first carriage 15 further includes a protrusion 58 that protrudes toward the lateral plate 52 beyond the second carriage 16 when the first carriage 15 is docked with the second carriage 16. The protrusion 58 is used for detecting a reference position of the first carriage 15. Specifically, a position where the protrusion 58 contacts the lateral plate 52 is detected by, for example, detecting a change in a drive current of the drive motor 21, and the first carriage 15 is moved from that position to a direction opposite the lateral plate 52 by a predetermined amount and the resultant position of the first carriage 15 is set as the reference position. A home position of the first carriage 15 can be detected in a manner similar to detection of the reference position of the first carriage 15 as described above, and may be the same as or different from the reference position.

Alternatively, a detection member may be provided to the first carriage 15 in place of the protrusion 58 so that relative positions of the detection member and a reference position provided to the main body of the image forming apparatus 1 are detected to determine the reference position of the first carriage 15. In such a case, the reference position of the first carriage 15 may be determined by, for example, a reference position detector such as a sensor provided to the main body of the image forming apparatus 1, or by matching of a result detected by the encoder sensor that detects the position of the first carriage 15 and a preset reference position.

A description is now given of a positioning mechanism that positions the first and second carriages 15 and 16 upon docking thereof according to a first illustrative embodiment.

Figure 6:
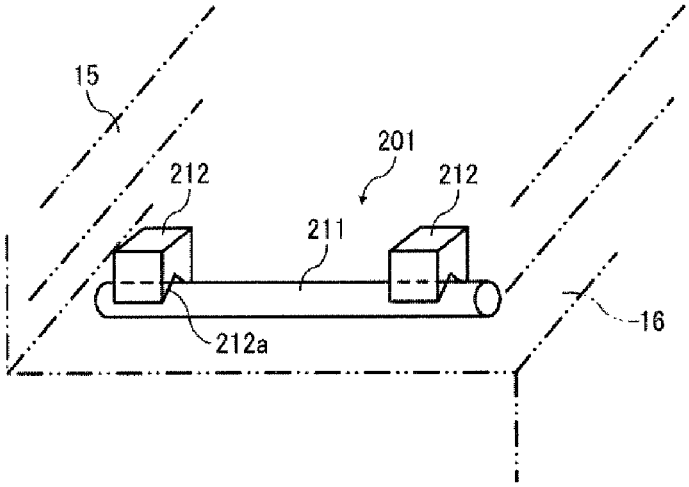
FIG. 6 is a perspective view illustrating an example of a configuration of a first positioning unit according to a first illustrative embodiment.
Figure 7A:
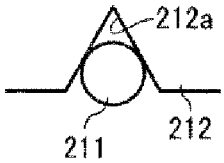
FIGS. 7A to 7D are vertical cross-sectional views respectively illustrating examples of shapes of a positioning notch in the first positioning unit.
Figure 7B:
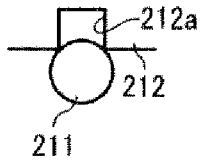
Figure 7C:
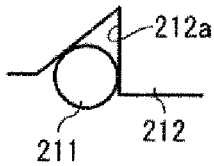
Figure 7D:
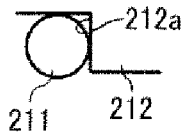
Figure 8:
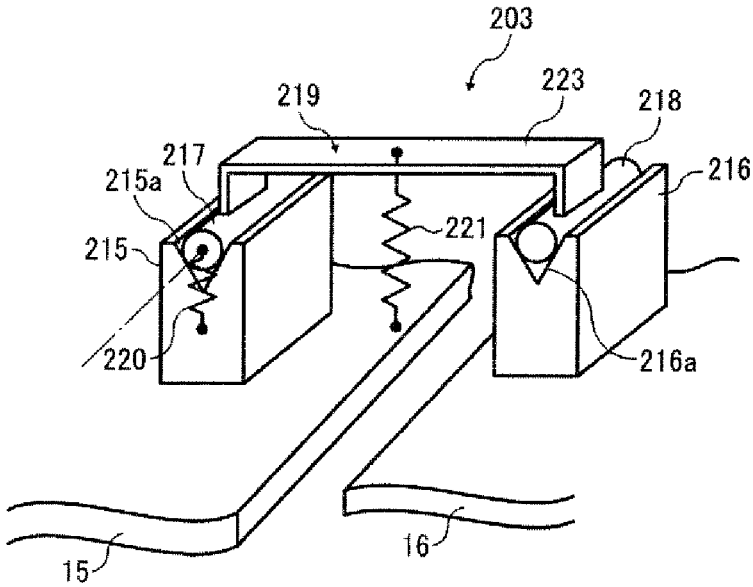
FIG. 8 is a perspective view illustrating an example of a configuration of a third positioning unit according to the first illustrative embodiment.

FIG. 6 is a perspective view illustrating an example of a configuration of a first positioning unit 201 according to the first illustrative embodiment. FIGS. 7A to 7D are vertical cross-sectional views respectively illustrating examples of shapes of a positioning notch 212*a* in the first positioning unit 201. FIG. 8 is a perspective view illustrating an example of a configuration of a third positioning unit 203 according to the first illustrative embodiment.

The first positioning unit 201 positions the second carriage 16 relative to the first carriage 15 in the sub-scanning direction, and includes a reference shaft 211 extending in the main scanning direction on the mount 55*ii* of the first carriage 15 and notched positioning members 212 provided to the second carriage 16 to engage the reference shaft 211.

The notched positioning members 212 are respectively provided at two separate positions on the second carriage 16 along the reference shaft 211. Formed in one face of each of the notched positioning members 212 are the positioning notches 212*a*. Each of the positioning notches 212*a* has a V-shaped cross-section in a direction perpendicular to the axial direction of the reference shaft 211 as illustrated in FIG. 7A. It is to be noted that, alternatively, the cross-section of each of the positioning notches 212*a* may be shaped like a rectangle, a single-sided slope, or a step, as illustrated in FIGS. 7B, 7C, and 7D, respectively.

It is to be noted that although the reference shaft 211 is provided to the first carriage 15 and the notched positioning members 212 are provided to the second carriage 16 according to the first illustrative embodiment, alternatively, the reference shaft 211 may be provided to the second carriage 16 and the notched positioning members 212 may be provided to the first carriage 15.

In addition, the second carriage 16 is positioned relative to the first carriage 15 in a direction rotating around the reference shaft 211 of the first carriage 15 as indicated by an arrow C in FIG. 4 (hereinafter referred to as a rotary direction or a height direction) by a second positioning unit 202 (shown in FIGS. 4 and 5). The second positioning unit 202 includes a support point 213 provided to the second carriage 16 that contacts the mount 55*i* of the first carriage 15 in the rotary direction upon docking. It is to be noted that, alternatively, the support point 213 may be provided to the first carriage 15 to contact the second carriage 16 in the height direction upon docking.

Further, the third positioning unit 203 positions the second carriage 16 relative to the first carriage 15 in the main scanning direction. The third positioning unit 203 includes grooved members 215 and 216 respectively provided to the first and second carriages 15 and 16, shafts 217 and 218 provided parallel to each other, and a positioning member 219 that couples the shafts 217 and 218 through a coupling member 223 shown in FIG. 8. The grooved members 215 and 216 respectively have grooves 215*a* and 216*a* provided parallel to each other in the sub-scanning direction, and the shafts 217 and 218 engage the grooves 215*a* and 216*a*, respectively.

The positioning member 219 is biased by an elastic member 220 shown in FIG. 8 such as a spring, such that the shaft 217 is rotatably pressed against the groove 215*a* of the grooved member 215. Further, the positioning member 219 is biased by a biasing member 221 such as a spring provided between the positioning member 219 and the first carriage 15 toward the first carriage 15 so that the shaft 218 is pressed against the groove 216*a* of the grooved member 216. Although respectively having a V-shaped cross-section in a direction perpendicular to an axial direction of the shafts 217 and 218, alternatively, the grooves 215*a* and 216*a* may have different cross-sectional shapes like the positioning notches 212*a* illustrated in FIGS. 7B, 7C, and 7D. It is to be noted that the positioning member 219 remains lifted by a holding member, not shown, when the first and second carriages 15 and 16 are separated from each other.

It is to be noted that although the grooved members 215 and 216 are respectively provided to the first and second carriages 15 and 16 and the shafts 217 and 218 are provided to the positioning member 219 according to the first illustrative embodiment, alternatively, the shafts 217 and 218 may be provided to the first and second carriages 15 and 16, respectively, and the grooved members 215 and 216 may be provided to the positioning member 219.

Figure 9:
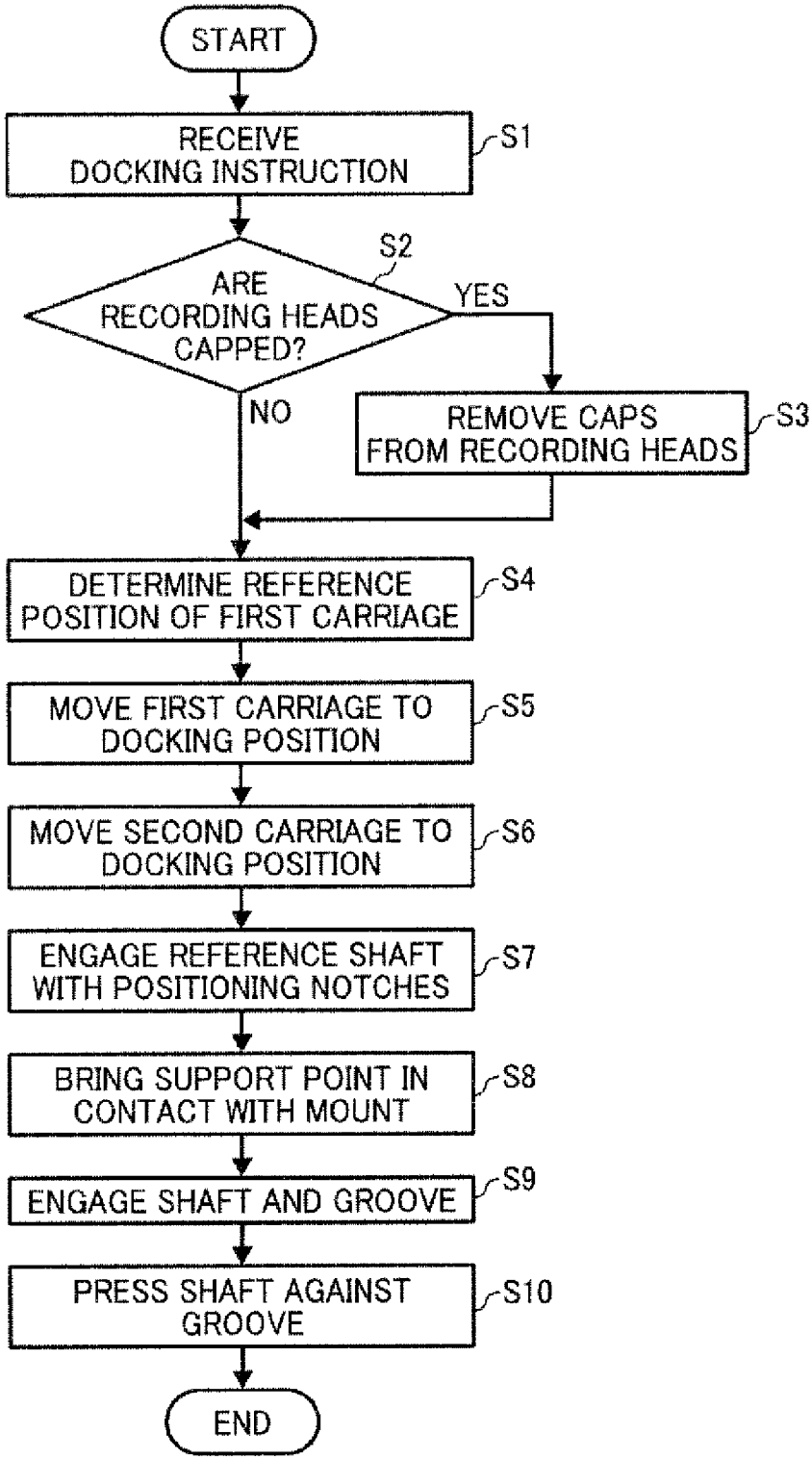
FIG. 9 is a flowchart illustrating steps in a process of positioning the second carriage relative to the first carriage.

A description is now given of positioning of the second carriage 16 relative to the first carriage 15 upon docking thereof, performed by the above-described positioning mechanism. FIG. 9 is a flowchart illustrating steps in a process of positioning the second carriage 16 relative to the first carriage 15.

Upon receiving an instruction to dock the second carriage 16 with the first carriage 15 at step S1, at step S2 whether or not the first recording heads 101 of the first carriage 15 are capped with the caps 71 is confirmed. When the first recording heads 101 of the first carriage 15 are capped with the caps 71 (YES at step S2), the process proceeds to step S3 to remove the caps 71 from the first recording heads 101, and then at step S4, the reference position of the first carriage 15 is determined. By contrast, when the first recording heads 101 of the first carriage 15 are not capped (NO at step S2), the process proceeds directly to step S4 so that the reference position of the first carriage 15 is determined. At step S5, the first carriage 15 is moved by a predetermined amount away from the reference position thus determined to be positioned at a docking position of the first carriage 15.

At step S6, the second carriage 16 is moved to a docking position of the second carriage 16. At step S7, the reference shaft 211 of the first positioning unit 201 provided to the first carriage 15 engages the positioning notches 212*a* of the notched positioning members 212 provided to the second carriage 16 to position the second carriage 16 relative to the first carriage 15 in the sub-scanning direction. At this time, the second carriage 16 is moved in the main scanning direction to be docked with the first carriage 15 by engaging the reference shaft 211 with the positioning notches 212*a* of the notched positioning members 212. Accordingly, the second carriage 16 is movable in the main scanning direction.

At step S8, the second carriage 16 is rotated around the reference shaft 211 so that the support point 213 of the second positioning unit 202 contacts the mount 55*i* of the first carriage 15 to position the second carriage 16 relative to the first carriage 15 in the rotary direction (or the height direction).

Thereafter, at step S9, the groove 216*a* of the grooved member 216 of the third positioning member 203 provided to the second carriage 16 engages the shaft 218 provided to the positioning member 219, and the shaft 218 is pressed against the groove 216*a* of the grooved member 216 by the biasing member 221 at step S10, thereby positioning the second carriage 16 relative to the first carriage 15 in the main scanning direction. At this time, because the second carriage 16 is movable in the main scanning direction as described above, the shaft 218 reliably contacts the groove 216*a* of the grooved member 216 upon engagement of the shaft 218 and the groove 216*a*. As a result, the second carriage 16 is accurately positioned relative to the first carriage 15 in the main scanning direction.

As described above, the relative positions of the first and second carriages 15 and 16 in the main scanning direction and the sub-scanning direction are set using shafts and notches or grooves, that is, the reference shaft 211, the positioning notches 212*a*, the shafts 217 and 218, and the grooves 215*a* and 216*a*. In addition, the support point 213 of the second positioning unit 202 contacts the mount 55*i* of the first carriage 15 to position the second carriage 16 relative to the first carriage 15 in the rotary direction or the height direction. Accordingly, the second carriage 16 is positioned relative to the first carriage 15 three-dimensionally. Further, the shafts 217 and 218 provided parallel to each other are used to position the second carriage 16 relative to the first carriage 15 in both the height direction and the main scanning direction, thereby preventing looseness of docking of the first and second carriages 15 and 16 caused by double positioning of the second carriage 16.

As a result, the first and second carriages 15 and 16 can be further accurately docked with each other, thereby providing higher-quality images.

As described above, the third positioning unit 203 includes the biasing member 221 that presses the positioning member 219 toward the first carriage 15, thereby reliably engaging the shafts 217 and 218 with the grooves 215*a* and 216*a* of the grooved members 215 and 216, respectively. Accordingly, the second carriage 16 is accurately positioned relative to the first carriage 15 in the height direction even when docking and separation of the first and second carriages 15 and 16 are performed repeatedly.

Thus, an uncluttered configuration involving use of the biasing member 221 prevents vibration of the second carriage 16 in the height direction while the second carriage 16 is scanning.

Further, the positioning member 219 of the third positioning unit 203 is swingable around the axial center of the shaft 217 to dock the first and second carriages 15 and 16 with each other while the shaft 217 is pressed against the groove 215*a*. Accordingly, by swinging the positioning member 219 around the axial center of the shaft 217 while the shaft 17 and the groove 215*a* engage with each other, the second carriage 16 is positioned relative to the first carriage 15 in the main scanning direction without interfering with positioning of the second carriage 16 in the height direction.

When the second carriage 16 is docked with the first carriage 15, first, the second carriages 16 is positioned relative to the first carriage 15 in the sub-scanning direction by the first positioning unit 201, and then the second and third positioning units 202 and 203 position the second carriage 16 relative to the first carriage 15 in the rotary direction and the main scanning direction. As a result, the second carriage 16 is positioned with good reproducibility both in the main scanning direction and the rotary direction.

Figure 10:
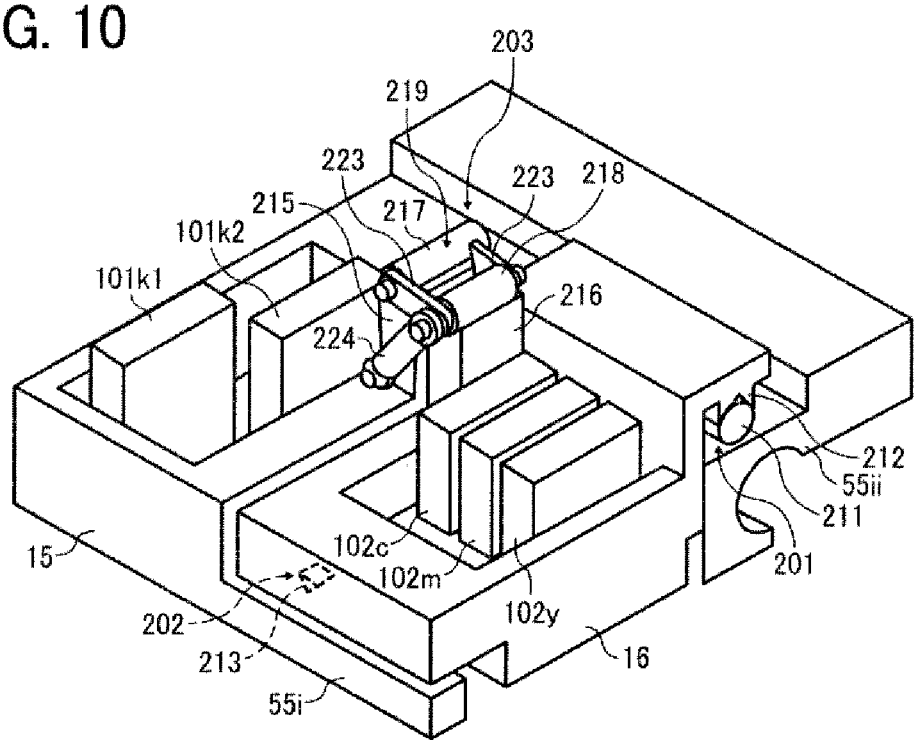
FIG. 10 is a perspective view illustrating an example of a configuration of the first and second carriages docked with each other according to a second illustrative embodiment.
Figure 11:
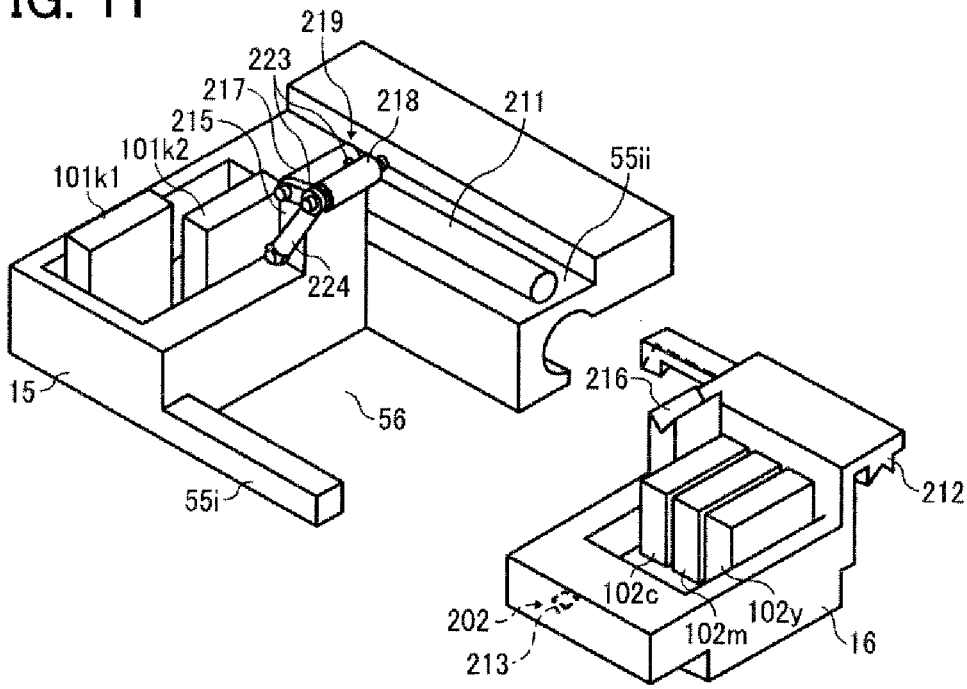
FIG. 11 is a perspective view illustrating an example of a configuration of the first and second carriages separated from each other according to the second illustrative embodiment.
Figure 12:
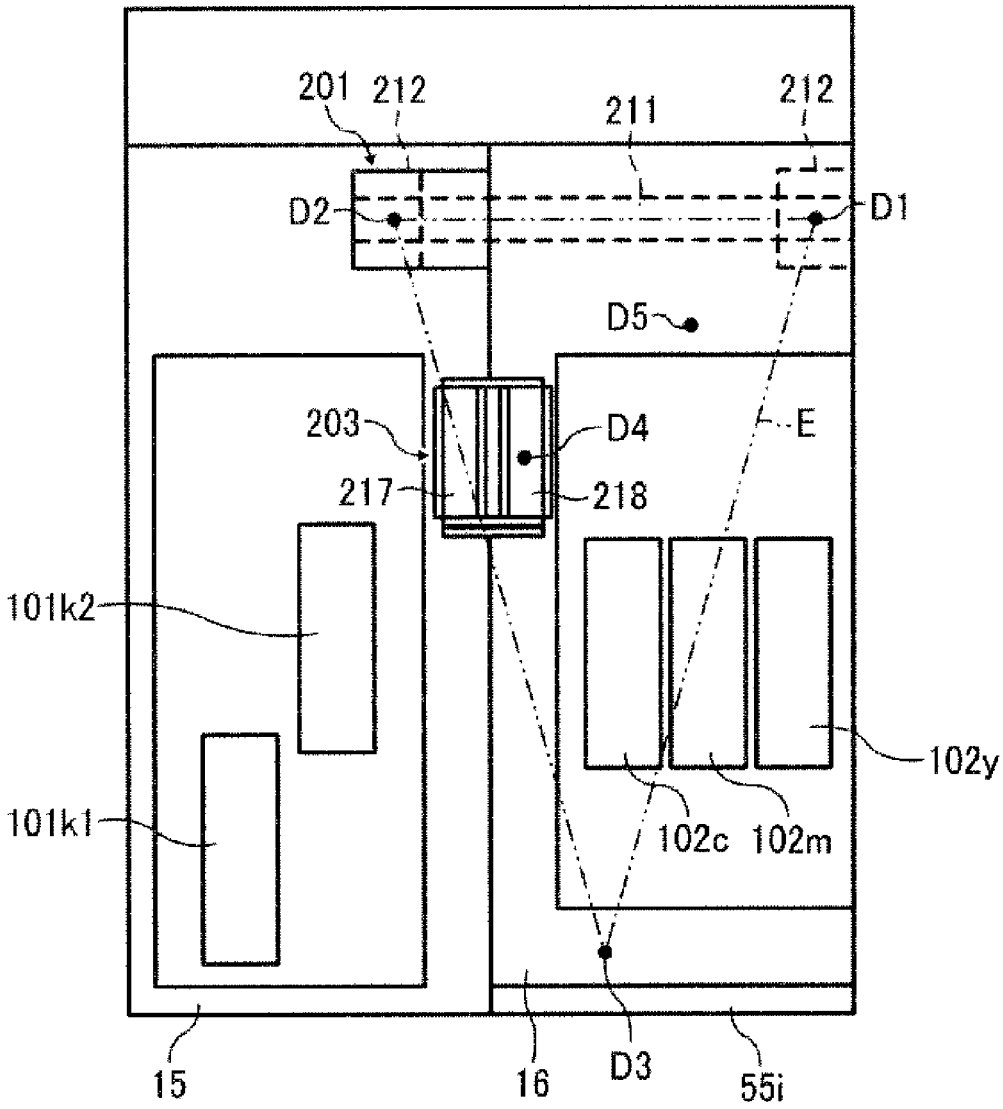
FIG. 12 is a top view illustrating the example of the configuration of the first and second carriages docked with each other according to the second illustrative embodiment.

A description is now given of a second illustrative embodiment of the present invention. FIG. 10 is a perspective view illustrating an example of a configuration of the first and second carriages 15 and 16 docked with each other according to the second illustrative embodiment. FIG. 11 is a perspective view illustrating an example of a configuration of the first and second carriages 15 and 16 separated from each other according to the second illustrative embodiment. FIG. 12 is a top view illustrating the example of the configuration of the first and second carriages 15 and 16 docked with each other according to the second illustrative embodiment.

In the second illustrative embodiment, the reference shaft 211 of the first positioning unit 201 is extended in a direction opposite the second carriage 16 beyond a portion where the shaft 218 and the grooved member 216 engage with each other. In addition, one of the notched positioning members 212 provided closer to the first carriage 15 engages the reference shaft 211 at a position beyond the portion where the shaft 218 and the grooved member 216 engage each other in the direction opposite the second carriage 16.

It is to be noted that the positioning member 219 remains lifted by a holding member 224 when the first and second carriages 15 and 16 are separated from each other. By contrast, when the first and second carriages 15 and 16 are docked with each other, the positioning member 219 is pressed toward the first carriage 15 by a biasing member such as a spring, not shown, in a manner similar to the first illustrative embodiment.

Referring to FIG. 12, the reference shaft 211 engages the notched positioning members 212 of the first positioning unit 201 at least at two positions, that is, points D1 and D2. The support point 213 of the second positioning unit 202 contacts the mount 55*i* of the first carriage 15 at point D3 upon docking of the first and second carriages 15 and 16. Both the center of gravity of the second carriage 16, that is, point D5, and a pressing point on the second carriage 16 where the biasing member 221 presses the positioning member 219 toward the second carriage 16, that is, point D4, are positioned within a triangle E formed by connecting the points D1, D2, and D3.

As a result, a fixing force that secures the docked carriages 15 and 16 in place can be exerted on the support point 213, so that the second carriage 16 can be reliably seated at the support point 213.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2010-035001, filed on Feb. 19, 2010 in the Japan Patent Office, which is hereby incorporated herein by reference in its entirety.

What is claimed is:

1. An image forming apparatus comprising:

a first carriage having a first recording head to eject black liquid droplets, movable in a main scanning direction;

a second carriage having a second recording head to eject color liquid droplets, separatably dockable with the first carriage within a main scanning range of the first carriage;

a first positioning unit to position the second carriage relative to the first carriage in a sub-scanning direction perpendicular to the main scanning direction, the first positioning unit comprising:

a reference shaft provided to one of the first and second carriages and extending in the main scanning direction; and notched positioning members provided to the other one of the first and second carriages to engage the reference shaft;

a second positioning unit provided to at least one of the first and second carriages to position the second carriage relative to the first carriage in a rotary direction rotating around the reference shaft, the second positioning unit contacting the other one of the first and second carriages in the rotary direction upon docking of the first and second carriages; and a third positioning unit to position the second carriage relative to the first carriage in the main scanning direction, the third positioning unit comprising:

a positioning member;

grooved members provided parallel to each other in the sub-scanning direction, the grooved members being provided to one of the carriages and the positioning member; and shafts provided parallel to each other in the sub-scanning direction to engage the grooved members, the shafts being provided to the other of the carriages and the positioning member.

2. The image forming apparatus according to claim 1, wherein the third positioning unit further comprises a biasing member to bias the positioning member toward the first and second carriages.

3. The image forming apparatus according to claim 2, wherein the biasing member biases the second carriage toward the first carriage.

4. The image forming apparatus according to claim 2, wherein:

the reference shaft engages the notched positioning members at least at two positions along the reference shaft; and a center of gravity of the second carriage and a position on the second carriage where the biasing member biases the positioning member toward the second carriage are positioned within a triangle defined by points of contact of the reference shaft with the notched positioning members and a point of contact of the second positioning unit with one of the first and second carriages.

5. The image forming apparatus according to claim 2, wherein the biasing member is a spring.

6. The image forming apparatus according to claim 1, wherein the positioning member is swingable around the axial center of one of the shafts provided on a first carriage side upon engagement of the one of the shafts with the grooved member provided on the first carriage side to engage the other one of the shafts with the grooved member provided on a second carriage side.

7. The image forming apparatus according to claim 1, wherein the second carriage is positioned relative to the first carriage by the second and third positioning units after being positioned by the first positioning unit upon docking of the first and second carriages.

8. The image forming apparatus according to claim 1, wherein the first and second carriages are docked with each other by moving the second carriage in the main scanning direction to engage the reference shaft with the notched positioning members.

9. A carriage docking mechanism for an image forming apparatus, comprising:

a first positioning unit to position a second carriage relative to a first carriage in a second direction orthogonal to a first direction, the first positioning unit comprising:

a reference shaft provided to one of the first and second carriages and extending in the first direction; and notched positioning members provided to the other one of the first and second carriages to engage the reference shaft;

a second positioning unit provided to at least one of the first and second carriages to position the second carriage relative to the first carriage in a third direction orthogonal to both the first direction and the second direction, the second positioning unit contacting the other one of the first and second carriages from the third direction upon docking of the first and second carriages; and a third positioning unit to position the second carriage relative to the first carriage in the first direction, comprising:

a positioning member;

parallel grooved members in the second direction provided to one of the carriages and the positioning member; and parallel shafts extending in the second direction to engage the grooved members, the shafts being provided to the other of the carriages and the positioning member.

10. An image forming apparatus comprising the carriage docking mechanism according to claim 9.

* * * * *